US007451553B2

(12) United States Patent
Dun et al.

(10) Patent No.: US 7,451,553 B2
(45) Date of Patent: Nov. 18, 2008

(54) CLEAN ROOM SAFETY SHOE ARTICLE WITH REMOVAL STEEL TOE HOUSING AND METHOD FOR TREATING THE SHOE

(75) Inventors: Jo Wei Dun, Shanghai (CN); Jen Lung Lan, Shanghai (CN); Chi Yin Wu, Shanghai (CN); Zheng Rong Sun, Shanghai (CN)

(73) Assignee: Semiconductor Manufacturing International (Shanghai) Corporation, Shanghai (CN)

( * ) Notice: Subject to any disclaimer, the term of this patent is extended or adjusted under 35 U.S.C. 154(b) by 194 days.

(21) Appl. No.: 11/394,598

(22) Filed: Mar. 31, 2006

(65) Prior Publication Data

US 2007/0251125 A1 Nov. 1, 2007

(30) Foreign Application Priority Data

Feb. 24, 2006 (CN) ..... 2006 1 0024139

(51) Int. Cl.
*A43B 1/02* (2006.01)
*A43C 13/14* (2006.01)

(52) U.S. Cl. ..... 36/9 R; 36/77 R; 36/100; 36/72 R

(58) Field of Classification Search ..... 36/9 R, 36/100, 101, 77 R, 72 R
See application file for complete search history.

(56) References Cited

U.S. PATENT DOCUMENTS 2,292,297 A * 8/1942 Sherlock ..... 36/1
2,742,715 A * 4/1956 Meltzer ..... 36/100
RE24,897 E * 11/1960 Schlecht ..... 36/72 R
4,333,248 A * 6/1982 Samuels ..... 36/72 R
4,995,174 A * 2/1991 Hong et al. ..... 36/72 R
5,410,821 A * 5/1995 Hilgendorf ..... 36/100
5,822,888 A * 10/1998 Terry ..... 36/100
6,131,312 A * 10/2000 Hung ..... 36/77 R
6,272,771 B1 * 8/2001 Rodi ..... 36/77 R
6,286,234 B1 * 9/2001 Smith, Jr. ..... 36/131
6,836,980 B2 * 1/2005 Woods ..... 36/110
2003/0213149 A1 * 11/2003 Woods ..... 36/110
2005/0268495 A1 * 12/2005 Schenone ..... 36/100
2007/0068045 A1 * 3/2007 Condie ..... 36/101
2007/0130802 A1 * 6/2007 Condie ..... 36/101

* cited by examiner

*Primary Examiner*—Marie Patterson
(74) *Attorney, Agent, or Firm*—Townsend and Townsend and Crew LLP

(57) ABSTRACT

A clean room shoe article, e.g., shoe, boot, safety shoe, safety boot. The article has a sole region. The article has an upper particle free polymer material having a toe region and an ankle region. The upper particle free polymer material is coupled to the sole region. The upper particle free polymer material is capable of enclosing a foot of a human user. The toe region houses an entirety of toes of the human user. The article has a steel toe housing member enclosing and protecting the entirety of the toes of the human user. The article has an enclosure provided in the toe region of the upper particle free polymer material. The enclosure is adapted to house the steel toe housing member. A sealing region is provided within a vicinity of the enclosure. The sealing region is adapted to maintain the steel toe housing member within the enclosure and is also adapted to open and remove the steel toe housing member from the enclosure provided in the toe region of the upper particle free polymer member.

19 Claims, 3 Drawing Sheets

CLEAN ROOM SAFETY SHOE ARTICLE WITH REMOVAL STEEL TOE HOUSING AND METHOD FOR TREATING THE SHOE

CROSS-REFERENCES TO RELATED APPLICATIONS

This application claims priority to Chinese Application No. 200610024139.5; filed on Feb. 24, 2006; commonly assigned, and of which is hereby incorporated by reference for all purposes.

BACKGROUND OF THE INVENTION

The present invention is directed to integrated circuits and their processing for the manufacture of semiconductor devices. More particularly, the invention provides a method and device for a clean room shoe and/or boot for the manufacture of integrated circuits. As merely an example, the shoe and/or boot is used in a clean room facility having a rating of about Class 100, Class 10, or better. But it would be recognized that the invention has a much broader range of applicability.

Integrated circuits have evolved from a handful of interconnected devices fabricated on a single chip of silicon to millions of devices. Conventional integrated circuits provide performance and complexity far beyond what was originally imagined. In order to achieve improvements in complexity and circuit density (i.e., the number of devices capable of being packed onto a given chip area), the size of the smallest device feature, also known as the device "geometry", has become smaller with each generation of integrated circuits.

Increasing circuit density has not only improved the complexity and performance of integrated circuits but has also provided lower cost parts to the consumer. An integrated circuit or chip fabrication facility can cost hundreds of millions, or even billions, of U.S. dollars. Each fabrication facility will have a certain throughput of wafers, and each wafer will have a certain number of integrated circuits on it. Therefore, by making the individual devices of an integrated circuit smaller, more devices may be fabricated on each wafer, thus increasing the output of the fabrication facility. Making devices smaller is very challenging, as each process used in integrated fabrication has a limit. That is to say, a given process typically only works down to a certain feature size, and then either the process or the device layout needs to be changed. Additionally, as devices require faster and faster designs, improved fabrication facilities and other related articles must be improved.

An example of an article that has limitations is a clean room garment and shoes. These garments and shoes must periodically be washed in order to maintain a substantially particle free environment in conventional fabrication facilities, commonly called wafer fabs. Unfortunately, life expectancy of clean room garments and shoes are often limited. These and other limitations of clean room garments can be found throughout the present specification and more particularly below.

From the above, it is seen that an improved technique for processing semiconductor devices including cleaning clean room garments is desired.

BRIEF SUMMARY OF THE INVENTION

According to the present invention, techniques for processing integrated circuits for the manufacture of semiconductor devices are provided. More particularly, the invention provides a method and device for a clean room shoe and/or boot for the manufacture of integrated circuits. As merely an example, the shoe and/or boot is used in a clean room facility having a rating of about Class 100, Class 10, or better. But it would be recognized that the invention has a much broader range of applicability.

In a specific embodiment, the present invention provides a clean room shoe article, e.g., shoe, boot, safety shoe, safety boot. The article has a sole region. The article has an upper particle free polymer material having a toe region and an ankle region. The upper particle free polymer material is coupled to the sole region. The upper particle free polymer material is capable of enclosing a foot of a human user. The toe region houses an entirety of toes of the human user. The article has a steel toe housing member enclosing and protecting the entirety of the toes of the human user. The article has an enclosure provided in the toe region of the upper particle free polymer material. The enclosure is adapted to house the steel toe housing member. A sealing region is provided within a vicinity of the enclosure. The sealing region is adapted to maintain the steel toe housing member within the enclosure and is also adapted to open and remove the steel toe housing member from the enclosure provided in the toe region of the upper particle free polymer material.

In an alternative specific embodiment, the present invention provides a method for cleaning a clean room shoe article, e.g., shoe, boot, safety shoe, safety boot. The method includes providing the article. The article has a sole region. The article has an upper particle free polymer material having a toe region and an ankle region. The upper particle free polymer material is coupled to the sole region. The upper particle free polymer material is capable of enclosing a foot of a human user. The toe region houses an entirety of toes of the human user. The article has a steel toe housing member enclosing and protecting the entirety of the toes of the human user. The article has an enclosure provided in the toe region of the upper particle free polymer material. The enclosure is adapted to house the steel toe housing member. A sealing region is provided within a vicinity of the enclosure. The sealing region is adapted to maintain the steel toe housing member within the enclosure and is also adapted to open and remove the steel toe housing member from the enclosure provided in the toe region of the upper particle free polymer member. In a specific embodiment, the method includes releasing the sealing region and removing at least the steel toe housing member from the enclosure. In a preferred embodiment, the steel toe housing member is free and clear from the article. The method includes subjecting the clean room shoe article without the steel toe housing member to one or more cleaning processes.

Many benefits are achieved by way of the present invention over conventional techniques. For example, the present technique provides an easy to use process that relies upon conventional technology. In some embodiments, the method provides higher device yields in dies per wafer. Additionally, the method provides a process that is compatible with conventional process technology without substantial modifications to conventional equipment and processes. Preferably, the invention provides for an improved clean room shower that can withstand multiple washings without substantial damage to the clean room shoe according to a specific embodiment. Depending upon the embodiment, one or more of these benefits may be achieved. These and other benefits will be described in more throughout the present specification and more particularly below.

Various additional objects, features and advantages of the present invention can be more fully appreciated with reference to the detailed description and accompanying drawings that follow.

DETAILED DESCRIPTION OF THE INVENTION

According to the present invention, techniques for processing integrated circuits for the manufacture of semiconductor devices are provided. More particularly, the invention provides a method and device for a clean room shoe and/or boot for the manufacture of integrated circuits. As merely an example, the shoe and/or boot is used in a clean room facility having a rating of about Class 100, Class 10, or better. But it would be recognized that the invention has a much broader range of applicability.

Figure 1:
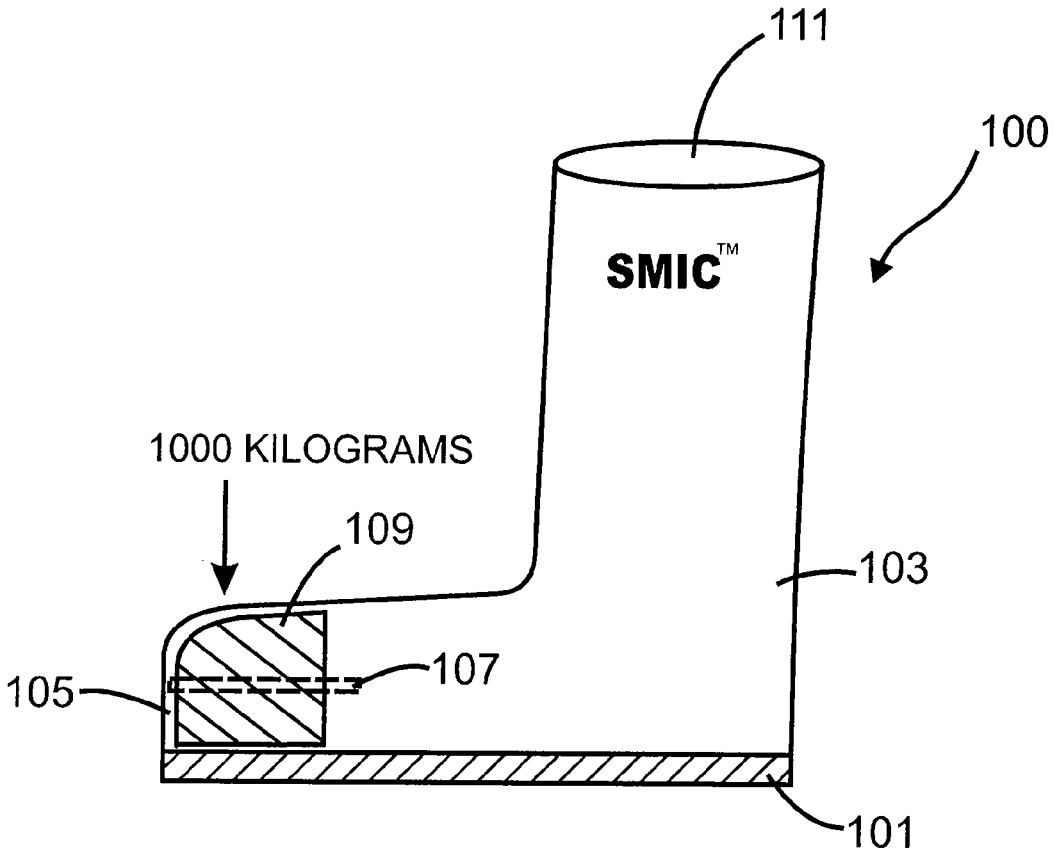
FIG. 1 is a simplified side-view diagram of a clean room shoe according to an embodiment of the present invention.

FIG. 1 is a simplified side-view diagram of a clean room shoe 100 according to an embodiment of the present invention. This diagram is merely an example, which should not unduly limit the scope of the claims herein. One of ordinary skill in the art would recognize other variations, modifications, and alternatives. As shown is a clean room shoe article 100, e.g., shoe, boot, safety shoe, safety boot. The article has a sole region 101. The article has an upper particle free polymer material 103 having a toe region 105 and an ankle region 111. The upper particle free polymer material is coupled to the sole region. The upper particle free polymer material is capable of enclosing a foot of a human user. The toe region 105 houses an entirety of toes of the human user. The article has a steel toe housing member 109 enclosing and protecting the entirety of the toes of the human user. The article has an enclosure provided in the toe region of the upper particle free polymer material. The enclosure is adapted to house the steel toe housing member. In a preferred embodiment, the enclosure can be a "pocket region" within the toe region.

In a specific embodiment, the article has a sealing region 107 is provided within a vicinity of the enclosure. The sealing region is adapted to maintain the steel toe housing member within the enclosure and is also adapted to open and remove the steel toe housing member from the enclosure provided in the toe region of the upper particle free polymer member. As shown, the sealing region is closed and seals the steel toe housing member within the enclosure. Of course, there can be other variations, modifications, and alternatives. Further details of the sealing region are provided throughout the present specification and more particularly below.

Figure 2:
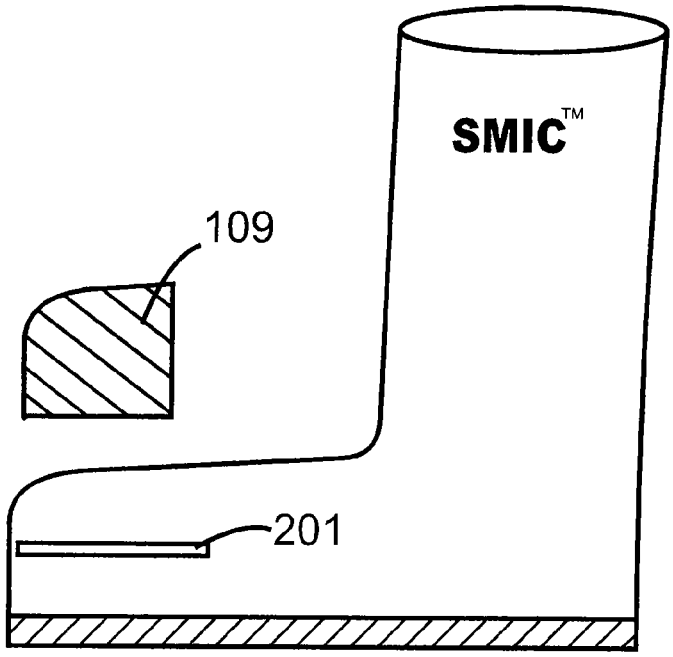
FIG. 2 is a simplified side-view diagram of an alternative clean room shoe according to an embodiment of the present invention.

FIG. 2 is a simplified side-view diagram of an alternative clean room shoe according to an embodiment of the present invention. This diagram is merely an example, which should not unduly limit the scope of the claims herein. One of ordinary skill in the art would recognize other variations, modifications, and alternatives. As shown, the article has sealing region 201, which has been opened. Once opened, 109 the steel toe housing member can be removed. In a specific embodiment, the sealing region can be any suitable member, e.g., a zipper, a zip lock region, one or more buttons.

Figure 3:
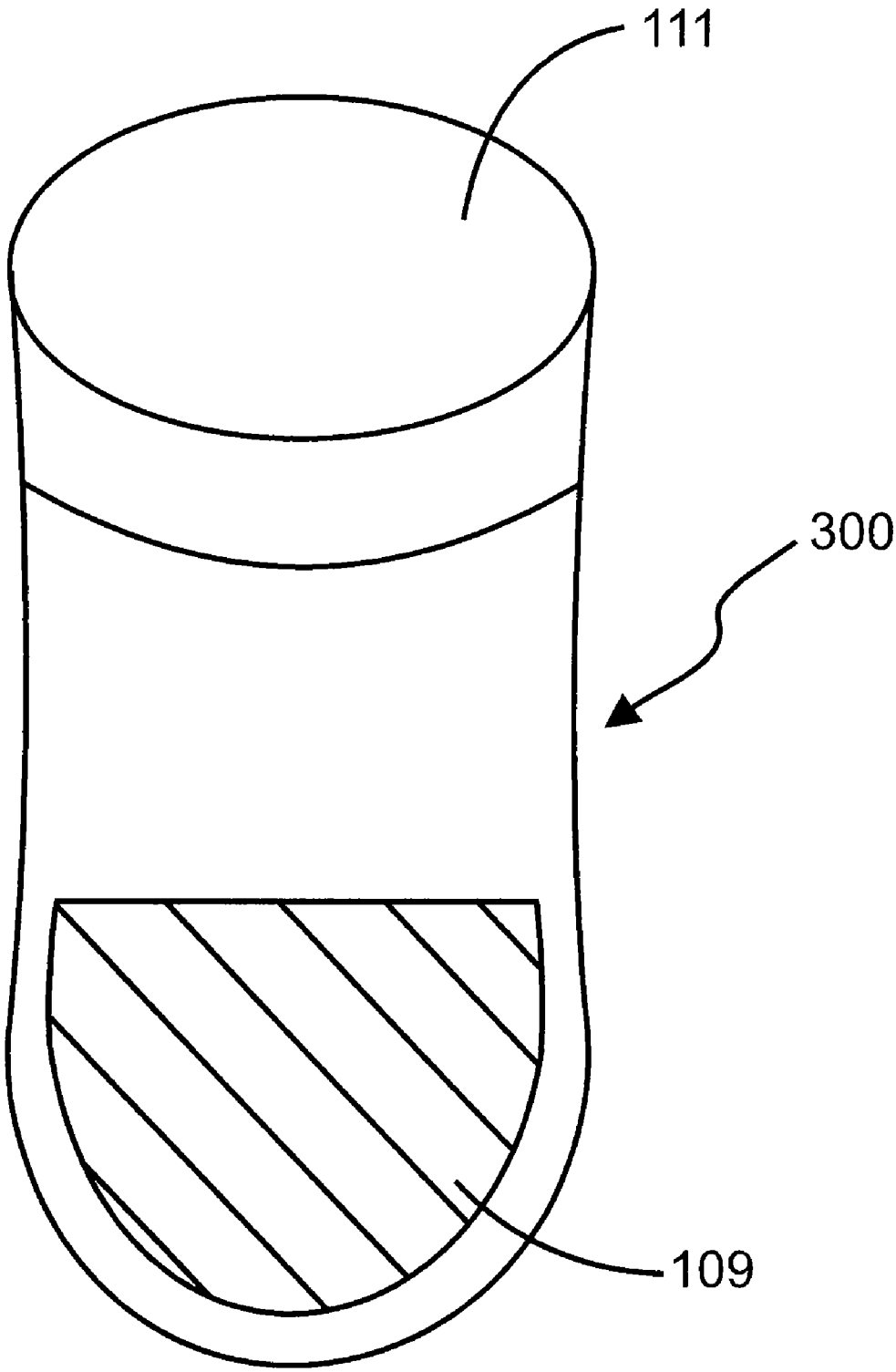
FIG. 3 is a top-view diagram of a clean room shoe according to an embodiment of the present invention.

FIG. 3 is a top-view diagram 300 of a clean room shoe according to an embodiment of the present invention. This diagram is merely an example, which should not unduly limit the scope of the claims herein. One of ordinary skill in the art would recognize other variations, modifications, and alternatives. As shown, the top view diagram of the article includes steel toe housing member 109 and ankle region 111. The article also includes the upper particle free polymer material. In a specific embodiment, the material can be polyethylene or other particle free material. Of course, there can be other variations, modifications, and alternatives.

A method for cleaning a shoe article according to an embodiment of the present invention may be outlined as follows.

1. Provide a shoe article (which has been described above);
2. Release the sealing region;
3. Remove at least the steel toe housing member from the enclosure to free and clear from the article;
4. Subject the clean room shoe article without the steel toe housing member to one or more cleaning processes;
5. Inspect clean room shoe article;
6. Insert the steel toe housing member into the enclosure;
7. Seal sealing region;
8. Use shoe article in clean room;
9. Repeat steps 2 through 8; and
10. Perform other steps, as desired.

The above sequence of steps provides a method according to an embodiment of the present invention. In a specific embodiment, the present invention provides a method for cleaning a shoe article, which removes the steel toe housing member. Other alternatives can also be provided where steps are added, one or more steps are removed, or one or more steps are provided in a different sequence without departing from the scope of the claims herein. Details of the present method and structure can be found throughout the present specification and more particularly below.

Figure 4:
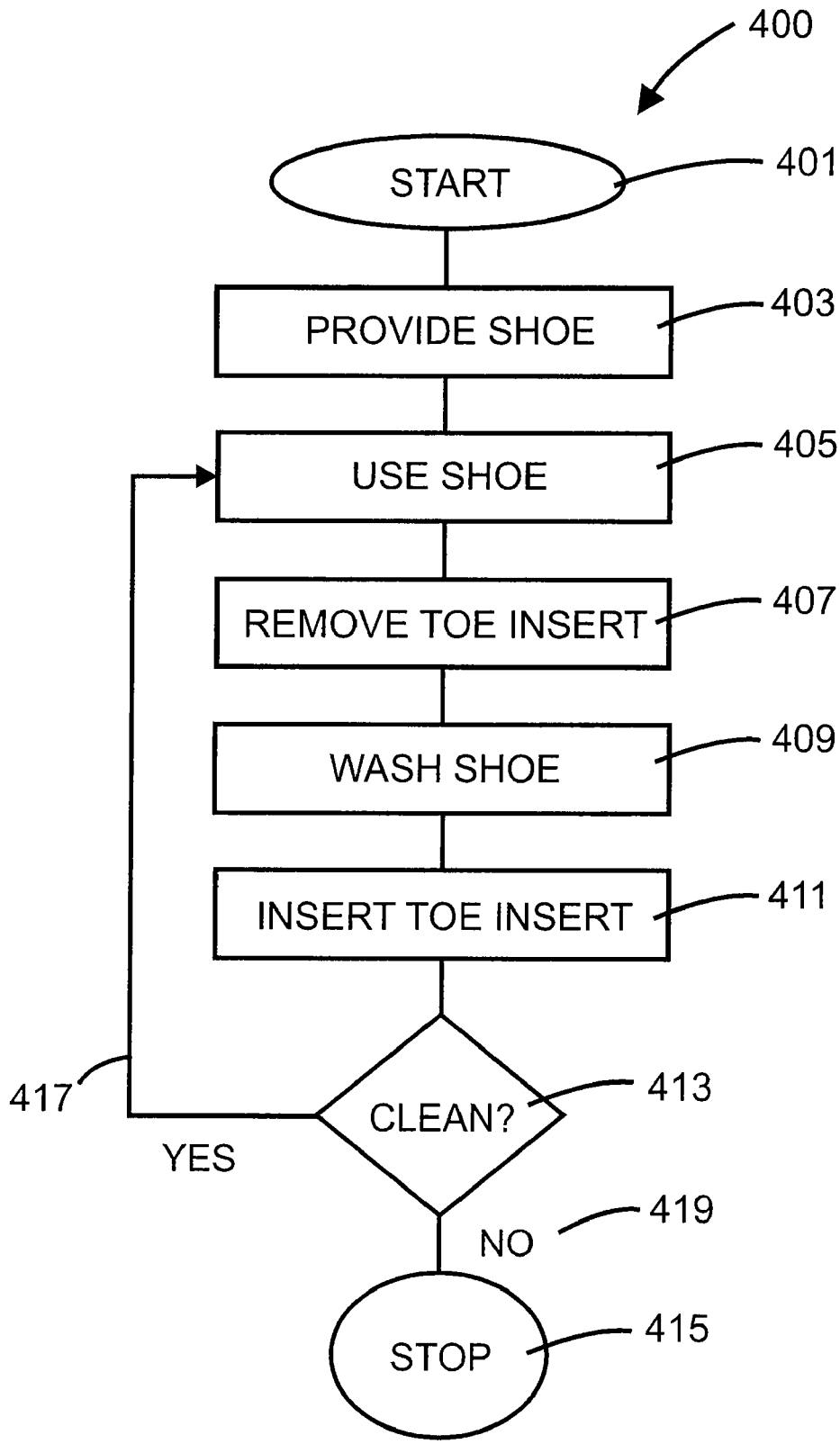
FIG. 4 is a simplified flow diagram of a cleaning process according to an embodiment of the present invention.

FIG. 4 is a simplified flow diagram 400 of a cleaning process according to an embodiment of the present invention. This diagram is merely an example, which should not unduly limit the scope of the claims herein. One of ordinary skill in the art would recognize other variations, modifications, and alternatives. As shown, the method begins at start, step 401. In a specific embodiment, the method includes providing the shoe article, step 403. The article has a sole region. The article has an upper particle free polymer material having a toe region and an ankle region. The upper particle free polymer material is coupled to the sole region. The upper particle free polymer material is capable of enclosing a foot of a human user. The toe region houses an entirety of toes of the human user. The article has a steel toe housing member enclosing and protecting the entirety of the toes of the human user. The article has an enclosure provided in the toe region of the upper particle free polymer material. The enclosure is adapted to house the steel toe housing member.

A sealing region is provided within a vicinity of the enclosure. The sealing region is adapted to maintain the steel toe housing member within the enclosure and is also adapted to open and remove the steel toe housing member from the enclosure provided in the toe region of the upper particle free polymer member. In a specific embodiment, the method includes releasing the sealing region and removing at least the steel toe housing member from the enclosure. In a preferred embodiment, the steel toe housing member is free and clear from the article. The method includes subjecting the clean room shoe article without the steel toe housing member to one or more cleaning processes.

In a specific embodiment, the method includes using (step 405) the shoe article. The shoe article is used in a clean room environment. The shoe article is preferably a safety shoe and/or boot with a steel toe member to protect the toes of a user. The steel toe member is capable of withstanding a force of about one metric ton and less according to a specific embodiment. Of course, there can be other variations, modifications, and alternatives.

In a specific embodiment, the method removes the steel toe housing member from the enclosure, step 407. The method unseals the sealing region to expose the steel toe housing member according to a specific embodiment. Depending upon the embodiment, the sealing region can be a zipper, zip lock apparatus, buttons, or other locking devices. Of course, there can be other variations, modifications, and alternatives.

The method subjects the shoe article without steel toe member into a cleaning process, step 409. The cleaning process can be a combination of solvents, water based solutions, surfactants, and other solutions to remove contaminants and/or particles from the shoe article. Of course, there are other variations, modifications, and alternatives.

In a specific embodiment, the method inserts (step 411) the steel toe housing member into the enclosure of the shoe article after cleaning. Depending upon the embodiment, the method determines if the cleaning process is acceptable, step 413. If the cleaning process is acceptable and the shoe article meets specifications, the shoe article is used again, step 405, via branch 417. Alternatively, the method goes to stop, step 415, via branch 419. Of course, there are other variations, modifications, and alternatives.

The above sequence of steps provides a method according to an embodiment of the present invention. In a specific embodiment, the present invention provides a method for cleaning a shoe article, which removes the steel toe housing member. Other alternatives can also be provided where steps are added, one or more steps are removed, or one or more steps are provided in a different sequence without departing from the scope of the claims herein.

It is also understood that the examples and embodiments described herein are for illustrative purposes only and that various modifications or changes in light thereof will be suggested to persons skilled in the art and are to be included within the spirit and purview of this application and scope of the appended claims.

What is claimed is:

1. A clean room shoe article comprising:

a sole region;

an upper particle free polymer material having a toe region and an ankle region, the upper particle free polymer material coupled to the sole region, the upper particle free polymer material being capable of enclosing a foot of a human user, the toe region housing an entirety of toes of the human user;

a steel toe housing member enclosing and protecting the entirety of the toes of the human user;

an enclosure provided in the toe region of the upper particle free polymer material, the enclosure being adapted to house the steel toe housing member; and a sealing region provided within a vicinity of the enclosure, the sealing region being adapted to maintain the steel toe housing member within the enclosure and being adapted to open and remove the steel toe housing member from the enclosure provided in the toe region of the upper particle free polymer member.

2. The article of claim 1 wherein the sole region comprises thickness of polymer material, the thickness of polymer material being adapted to cushion the human user.

3. The article of claim 2 wherein the thickness of polymer material comprises a rubber material.

4. The article of claim 1 wherein the steel toe housing member comprises a thickness of rigid steel.

5. The article of claim 4 wherein the steel toe housing member is capable of withstanding a force of 1000 kilograms.

6. The article of claim 1 wherein the upper particle free polymer material comprises polyethylene material or other particle free material.

7. The article of claim 1 wherein the sealing region comprises a zipper.

8. The article of claim 1 wherein the sealing region comprises a zip lock region.

9. The article of claim 1 wherein the sealing region comprises one or more buttons.

10. The article of claim 1 wherein the enclosure is a portion of the upper particle free polymer material.

11. A method for treating one or more clean room shoe articles comprising:

providing a clean room shoe article, the clean room shoe article comprising:

a sole region;

an upper particle free polymer material having a toe region and an ankle region, the upper particle free polymer material coupled to the sole region, the upper particle free polymer material being capable of enclosing a foot of a human user, the toe region housing an entirety of toes of the human user;

a steel toe housing member enclosing and protecting the entirety of the toes of the human user;

an enclosure provided in the toe region of the upper particle free polymer material, the enclosure being adapted to house the steel toe housing member; and a sealing region provided within a vicinity of the enclosure, the sealing region being adapted to maintain the steel toe housing member within the enclosure and being adapted to open and remove the steel toe housing member from the enclosure provided in the toe region of the upper particle free polymer material;

releasing the sealing region;

removing at least the steel toe housing member from the enclosure; and subjecting the clean room shoe article without the steel toe housing member to one or more cleaning processes.

12. The method of claim 11 further comprising inserting a second steel toe housing member into the enclosure; and sealing the sealing region.

13. The method of claim 11 further comprising repeating the steps of providing, releasing, removing, and subjecting for at least five or more cleaning cycles.

14. The method of claim 11 wherein one or more cleaning processes has a surfactant treatment.

15. The method of claim 11 wherein the releasing comprises opening the sealing region.

16. The method of claim 11 wherein the sole region comprises thickness of polymer material, the thickness of polymer material being adapted to cushion the human user.

17. The method of claim 11 wherein the thickness of polymer material comprises a rubber material.

18. The method of claim 11 wherein the steel toe housing member comprises a thickness of rigid steel.

19. The method of claim 11 wherein the steel toe housing member is capable of withstanding a force of 1000 kilograms.

* * * * *